US007104851B1

(12) United States Patent
Gonring et al.

(10) Patent No.: US 7,104,851 B1
(45) Date of Patent: Sep. 12, 2006

(54) SECURITY SYSTEM FOR A MARINE VESSEL

(75) Inventors: Steven J. Gonring, Slinger, WI (US); Kevin W. Bradley, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/030,486

(22) Filed: Jan. 6, 2005

(51) Int. Cl.
*B63H 23/00* (2006.01)

(52) U.S. Cl. ..... 440/1; 340/5.31; 340/426.1; 701/21

(58) Field of Classification Search ..... 440/1, 440/84; 701/21; 340/572.1, 572.3, 426.1, 340/5.31, 5.32; 375/224
See application file for complete search history.

(56) References Cited

U.S. PATENT DOCUMENTS

| | | | | |
|---|---|---|---|---|
| 4,058,792 | A | 11/1977 | Soltesz | 340/29 |
| 4,127,031 | A | 11/1978 | Barnes | 73/204 FR |
| 4,604,708 | A * | 8/1986 | Lewis | 340/5.32 |
| 4,806,926 | A * | 2/1989 | Nakamura | 340/5.31 |
| 5,319,698 | A | 6/1994 | Glidewell et al. | 379/39 |
| 5,418,537 | A | 5/1995 | Bird | 342/357 |
| 5,572,186 | A | 11/1996 | Traxler et al. | 340/426 |
| 6,025,780 | A * | 2/2000 | Bowers et al. | 340/572.3 |
| 6,265,966 | B1 | 7/2001 | Ireland et al. | 340/426 |
| 6,273,771 | B1 | 8/2001 | Buckley et al. | 440/84 |
| 6,352,045 | B1 * | 3/2002 | Takashima | 440/84 |
| 6,469,641 | B1 | 10/2002 | Lash et al. | 340/984 |
| 6,582,261 | B1 * | 6/2003 | Kanno | 440/84 |
| 6,611,556 | B1 * | 8/2003 | Koerner et al. | 375/224 |
| 6,885,289 | B1 * | 4/2005 | Nakai | 340/426.1 |

* cited by examiner

*Primary Examiner*—Lars A. Olson
(74) *Attorney, Agent, or Firm*—William D. Lanyi

(57) ABSTRACT

A security system for a marine vessel uses identification values to ascertain whether or not the devices used in a marine vessel control system are those which are expected. If an identification value is received by one device from another device, appropriate operation of the devices is permitted. However, if an incorrect identification value is received or no identification value is received, continued operation of the marine propulsion system is disabled.

3 Claims, 2 Drawing Sheets

SECURITY SYSTEM FOR A MARINE VESSEL

BACKGROUND OF THE INVENTION

1. Field of the Invention

The present invention generally relates to a security system for a marine vessel and, more particularly, to a system in which two or more devices communicate with each other to ascertain whether or not there is an improper combination of devices associated with the marine vessel system or whether a required device is absent from connection to the system.

2. Description of the Prior Art

Many different types of security systems are well known to those skilled in the art. These systems are typically configured to prevent, inhibit, or detect the theft or attempted theft of a component or an entire system. Some of these security systems are associated with marine vessels.

U.S. Pat. No. 4,058,792, which issued to Soltesz on Nov. 15, 1977, describes a ship security system. The security system comprises an electromechanical apparatus that is sensitive to substantial changes in the position or orientation of a floating structure, such as a boat. A sensor circuit means is employed for sensing unanticipated changes of conditions of the floating structure.

U.S. Pat. No. 4,127,031, which issued to Barnes on Nov. 28, 1978, describes a boat theft detector. Attempted boat theft is detected by measuring the increased displacement of the boat caused by the added weight of a thief. The device measures the slight sinking of the boat into the water under the added weight and automatically resets so as to be in readiness for responding to the next person.

U.S. Pat. No. 5,319,698, which issued to Glidewell et al. on Jun. 7, 1994, describes a security system for detecting and signaling the presence of abnormal security or hazardous conditions, such as unauthorized entry, glass breakage, fire, smoke, high water level, in individual units, such as a boat, a recreational vehicle, an automobile, which are located or stored in a given security area.

U.S. Pat. No. 5,418,537, which issued to Bird on May 23, 1995, describes the location of missing vehicles. It describes a method and apparatus for determining the present location of a missing vehicle, such as an automobile or marine vessel, using a global positioning system (GPS) that receives GPS signals from two or more GPS satellites.

U.S. Pat. No. 5,572,186, which issued to Traxler et al. on Nov. 5, 1996, describes a boat security system. The system is intended for protecting a vehicle and its contents including a protective cover having conductors threaded through a hollow seam and electrically connected to a two member electrical connector.

U.S. Pat. No. 6,265,966, which issued to Ireland et al. on Jul. 24, 2001, describes a marine security system for a vehicle which comprises a sensor assembly which can be releasably mounted to a vehicle or to an item contained therein. The sensor assembly includes a sensing device that is actuated upon sensing a predetermined change in inertia relative to the assembly. The sensing device actuates a transmitter within the sensor assembly to transmit a signal upon detection of the predetermined level of inertial change.

U.S. Pat. No. 6,469,641, which issued to Lash et al. on Oct. 22, 2002, describes a marine vessel monitoring system and method. It comprises a remote marine monitoring and control system that compiles security information and statistics for on-board equipment or unattended boats, uses a wireless transmitter to send this data to a user over a communications network and allows a user to remotely operate the user's boat in response.

U.S. Pat. No. 6,273,771, which issued to Buckley et al. on Aug. 14, 2001, discloses a control system for a marine vessel. The control system incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

The patents described above are hereby expressly incorporated by reference in the description of the present invention.

The theft of components from a marine vessel system, such as a marine propulsion system, is a serious problem. Although the theft can take many forms, one type of theft relates to the taking of an outboard motor from an owner's marine vessel and removing that outboard motor for use on the thief's marine vessel or, alternatively, for sale to another party. Unfortunately, marine security systems known to those skilled in the art do not prevent a thief from enjoying the illegal fruits of this type of larceny because the stolen outboard motor is usable on another marine vessel after the theft occurs. Theft relating to marine vessels can also include the stealing of various components associated with the marine vessel, such as GPS systems, depth monitors, various types of parameter display devices and navigational equipment, and other peripheral equipment that the legitimate owner of a marine vessel may purchase and install on the vessel.

It would therefore be significantly beneficial if a security system could be devised which deprives a thief from the use and enjoyment of stolen equipment.

SUMMARY OF THE INVENTION

A method for detecting an unintended combination of devices in a marine vessel system, in accordance with a preferred embodiment of the present invention, comprises the steps of receiving a first identification signal from a first device, comparing the first identification signal to a first expected identification value associated with the first device, and identifying a mismatched condition when the first identification signal does not conform to the first expected identification value. It should be understood that the mismatched condition can occur when the first identification signal is received properly but does not match the magnitude or value of the first expected identification value. Alternatively, a mismatched condition can occur when no first identification signal is received within a preselected time after it is expected.

The first identification signal can be transmitted by a second device to the first device. The first and second devices can be connected in signal communication with a common signal bus, such as the CAN system disclosed in U.S. Pat. No. 6,273,771.

The second device can be an engine control module (ECM) or a propulsion control module (PCM) of an internal combustion engine associated with the marine propulsion system. The first device can be a radio frequency identification device (RFID) attached to the engine or to the marine vessel with which the engine is used. Alternatively, the second device can be a security module that is rigidly attached to the marine vessel and the first device can be the engine control module or propulsion control module connected to a marine propulsion system of the marine vessel. The system can comprise a CAN bus.

Certain embodiments of the present invention can provide an alarm in response to the mismatched condition or, alternatively, can perform the step of disabling the system from operation in response to the mismatched condition.

Stated in slightly different terms, the method for providing security for a marine vessel system, in accordance with a preferred embodiment of the present invention, comprises the steps of providing a first device associated with the marine vessel system, requesting an identification signal from a second device associated with the marine vessel system, determining the propriety of the identification signal from the second device, and responding to the status of that propriety which is determined. It should be understood that the propriety of the identification signal can relate to the magnitude or numeric equivalence between an expected signal and a received signal or, alternatively, can relate to the absence of receipt of the identification signal from the second device.

The responding step can comprise a step of disabling the first device in response to the propriety being unacceptable. It can also comprise the step of providing an alarm in response to the propriety being unacceptable. The first device can be connected in signal communication with an engine of the marine vessel system and the second device can be a security module which is configured to transmit an actual identification value. The security module can be rigidly attached to the marine vessel and the first device can be associated with the marine propulsion system, such as the engine of an outboard motor. In certain embodiments of the present invention, the propriety of the identification signal received from the second device can be determined improper if it is not received by the first device within a preselected time after it is requested. The first and second devices can be connected in signal communication with a signal bus, such as a serial communication bus described in U.S. Pat. No. 6,273,771 which is described above. The second device can be a radio frequency identification device (RFID).

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
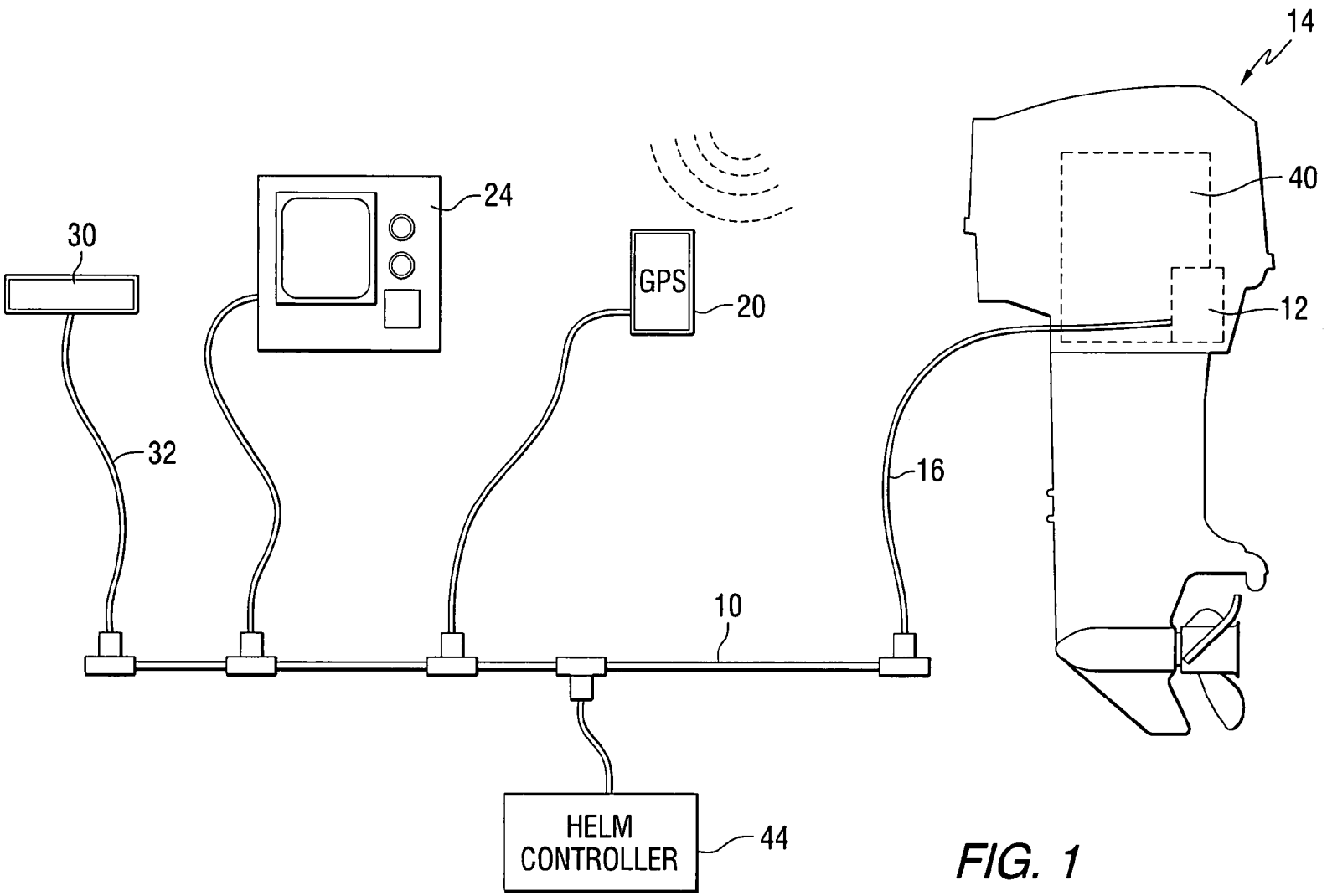
FIG. 1 illustrates a marine vessel control system and propulsion system incorporating the basic concepts of the present invention.

Throughout the description of the preferred embodiment of the present invention, like components will be identified by like reference numerals.

FIG. 1 is a highly schematic representation of a marine vessel system in which various devices are connected in signal communication with a serial communication bus 10. The serial communication bus 10 can be a CAN system such as the one described in U.S. Pat. No. 6,273,771. In the illustration of FIG. 1, a propulsion control module 12 of an outboard motor 14 is connected, by a communication link 16, to the bus 10. For purposes of illustration, a global positioning system (GPS) 20 is also shown connected to the bus 10 along with a monitor 24 that can be configured to provide information to the operator of a marine vessel relating to various parameters of the vessel and its marine propulsion system. A security module 30 is connected to the bus 10 by a communication link 32.

With continued reference to FIG. 1, the propulsion control module (PCM) 12 is typically associated with an internal combustion engine 40 of the outboard motor 14. It performs the basic function of controlling the operation of the engine 40. When the PCM 12 is connected to the bus 10, it can also control the operation of various other devices, such as the ones shown in FIG. 1. A helm controller 44 is also shown connected to the bus 10. Depending on the complexity of the marine vessel system, numerous other devices can be connected to the bus 10. Each of these devices can communicate with other devices through the use of a protocol that allows the devices to provide information and receive information that is transmitted on the bus 10.

A serious problem relating to marine vessel systems is the theft of components from a marine vessel. In other words, the outboard motor 14 might be removed surreptitiously from the marine vessel. The outboard motor 14 can then be used on the thief's marine vessel or, more likely, sold to a third party for use on a marine vessel owned by that third party. In known marine propulsion systems, a recipient of the stolen outboard motor 14 can connect it to a marine vessel and use it.

In order to inhibit the theft of components from a marine vessel, the present invention has several embodiments that can be used to prevent a thief, or a person buying the stolen device from a thief, from benefiting from the use of the stolen device. One embodiment of the present invention uses identification values that are stored by the security module 30 and the propulsion control module (PCM) 12. It is anticipated that when the marine vessel is first outfitted with the outboard motor 14, the propulsion control module (PCM) 12 is provided with a blank or zero identification number. An authorized installer of the outboard motor 14 would be empowered to cause the PCM 12 to communicate with the security module 30 to receive the identification value associated with the security module 30 and store the received value. It should be understood that the security module would typically be rigidly attached to the marine vessel and, in a particularly preferred embodiment of the present invention, hidden from view on the marine vessel. This security module 30 could be irremovably attached to the hull of the marine vessel within the bilge portion of the boat. It could be attached in such a way that removal or attempted removal of the security module 30 from the marine vessel would result in its destruction.

When the outboard motor 14 is first installed on the marine vessel, it accesses the identification value from the security module 30 and stores that value in its PCM 12. During subsequent use of the marine vessel and the outboard motor 14, the PCM 12 interrogates the security module 30 to request an identification value from the security module 30. This can be done by transmitting a request from the PCM 12 to the security module 30 on the bus 10. The security module 30 can then respond by transmitting its actual identification value to the PCM 12. If that actual value matches the expected value stored in the PCM 12, operation of the outboard motor 10 continues normally. However, if a mismatch is detected between the actual identification value of the security module 30 and the expected identification value stored in the PCM 12, the PCM 12 can take responsive action, such as providing an alarm signal or disabling the operation of the engine 40. In other words, if the PCM 12 detects that it is no longer associated with the security module 30 with which it was first installed and initiated, this mismatch is interpreted as being indicative that the outboard motor 14 has been stolen from its original vessel and installed on a new vessel that does not have the security module 30 with the proper identification value. If, alternatively, the outboard motor 14 is stolen and installed on a vessel without a security module 30, the request by the PCM 12 on the bus 10 will go unanswered. This lack of a response from an acceptable security module 30 is interpreted as an indication that the outboard motor 14 has been stolen and installed on an unauthorized marine vessel. This, also, can result in a disabling of the engine 40.

The basic concepts of the preferred embodiment of the present invention can also be used in a slightly different manner. Rather than providing a security module 30, the security functions performed by the module 30 can alternatively be provided by other devices connected to the marine vessel. In other words, the helm controller 44, the monitor 24, or any other component can be provided with the necessary software capability to store an identification value and provide it to the PCM 12 when requested by the PCM in a transmission on the bus 10. If a thief is unable to determine which component or device is acting as the security module, it would be necessary to remove all such devices from the marine vessel if the outboard motor 14 was to be used effectively by the thief.

Although not shown in FIG. 1, it should be understood that various types of marine vessel control systems can employ a touch pad numerical system that allows an operator to operate the marine vessel without the use of an ignition key. In other words, a simple code (e.g. "1234") can be selected by the operator as the initiation code which is used to start the ignition system of the marine vessel. A microprocessor would typically be used at the helm to allow the operator to enter the required code. That microprocessor could be equipped with the software necessary to perform the functions described above in conjunction with the security module 30. That microprocessor could be built into a console or steering mechanism so that it is secure from easy removal from the marine vessel.

It can be seen that the basic concept of the various embodiments of the present invention relate to a device, such as the PCM 12, requiring the receipt of a proper identification value from another device, such as the security module 30, in order for the PCM 12 to allow the engine 40 to operate. The failure to receive a proper identification value would indicate that something is wrong in the system. Either the outboard motor 14 has been stolen and moved to another vessel, without a proper security module 30, or something else has occurred to cause this mismatch in which the two devices are not associated with the same marine vessel. In certain embodiments of the present invention, it may not be desirable to completely disable the operation of the engine 40 when an improper identification value is received or when no identification value is received when expected. Alternatively, the PCM 12 can be programmed to require that the engine 40 only operate at idle speed, or below a preselected threshold, so that the operator of the marine vessel is not necessarily stranded but is inhibited from fully enjoying the benefits of the outboard motor 14. In other words, the outboard motor 14 can be used to return to port, but an investigation would be necessary to determine why the PCM 12 is not operating normally. This mode of operation of the present invention could guard against an inadvertent disconnection of the security module 30 or a failure for the security module to operate properly, even though no theft has occurred.

Figure 2:
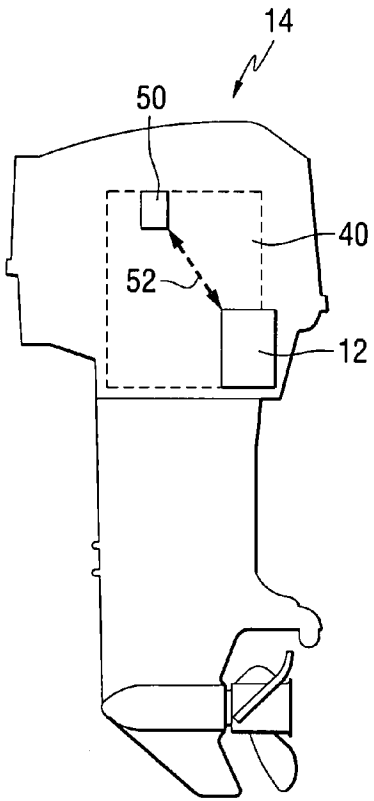
FIG. 2 shows an embodiment of the present invention used in conjunction with an outboard motor PCM and radio frequency identification device.

In the embodiment described above in conjunction with FIG. 1, a serial communication bus 10 is used to connect the various devices in signal communication with each other. In FIG. 2, an alternative embodiment is illustrated. The PCM 12 can be associated with an engine 40 to which a radio frequency identification device RFID 50 is attached. It is anticipated that the RFID tag 50 would be permanently and rigidly attached to the engine 40. In the event that the PCM 12 is improperly replaced with an inappropriate PCM 12, the engine 40 can be inhibited from operation. More specifically, when the PCM 12 is first installed on the engine 40, it is matched to an identification value stored by the RFID tag 50. When the PCM 12 transmits a radio frequency, represented by dashed arrow 52, the RFID tag 50 responds with its stored identification value. When the PCM 12 is first installed on the engine 40 of the outboard motor 14, it can be provided with a zero or blank magnitude of an identification value. When first initiated, the PCM 12 can interrogate the RFID tag 50 and receive the actual identification value stored in the RFID tag. That value is then stored in the PCM 12 as the expected identification value. At each subsequent interrogation by the PCM 12, the RFID tag 50 will respond with its actual identification value. If that value does not match the expected identification value stored in the PCM 12, the PCM 12 can disable the engine 40 so that operation of the outboard motor 14 is inhibited. This type of system can be used to assure that stolen PCM's are not used to replace original PCM's that were originally intended to be used with the engine 40. In certain applications of outboard motors 14, the PCM 12 determines the horsepower of the engine 40. By controlling the particular parameters used to operate the engine 40, a particular engine block can be made to perform differently merely by replacing the PCM 12 with a differently configured PCM. In order to inhibit this improper replacement of one PCM with a differently configured PCM, the embodiment described above in conjunction with FIG. 2 can be used. This embodiment of the present invention does not require a serial communication bus 10 as described above in conjunction with FIG. 1. Similarly, it does not require the use of a security module 30. The improper behavior toward which the embodiment of FIG. 2 is directed does not relate specifically to the theft of an outboard motor but, instead, to the improper installation of a PCM 12 with an engine 40 with which it was not originally intended to operate.

Figure 3:
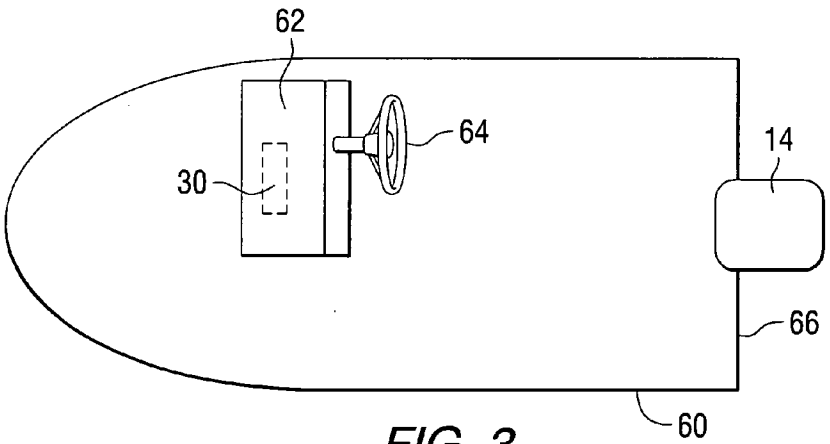
FIG. 3 shows a marine vessel incorporating a security module and an outboard motor made in accordance with a preferred embodiment of the present invention.

FIG. 3 is a schematic representation of a marine vessel 60 with a helm station 62, a steering wheel 64, and an outboard motor 14 attached to the transom 66 of the marine vessel 60. The security module 30 is represented by dashed lines within the console of the helm station 62. Not shown in FIG. 3 is the serial communication bus 10 which is described above in conjunction with FIG. 1. It can be seen that the security module 30 can be located at a position which is difficult to detect in a brief period of time. As a result, the theft of the outboard motor 14 is made less rewarding because stealing the outboard motor 14 without having the proper security module 30 will make the enjoyment of future use of the outboard motor 14 extremely difficult if not impossible.

Figure 4:
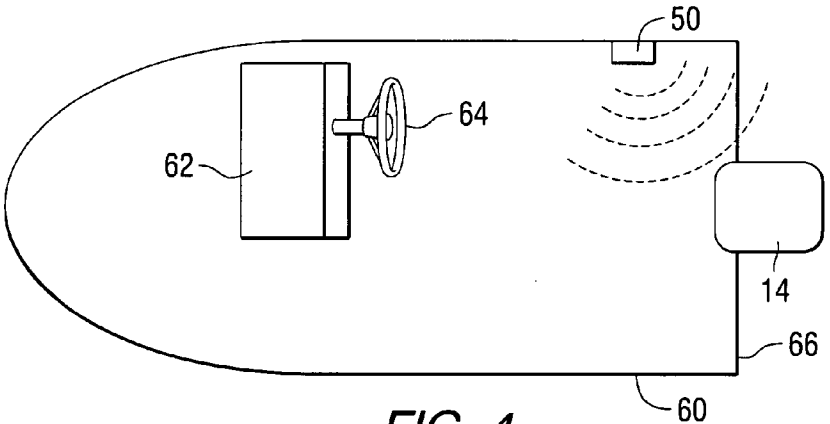
FIG. 4 shows an alternative embodiment of the present invention in which a radio frequency identification device is used in conjunction with a PCM of an outboard motor.

FIG. 4 shows a radio frequency identification device (RFID) 50 attached to the hull of the marine vessel 60. The embodiment shown in FIG. 4 is a slight variation of the embodiment described above in conjunction with FIG. 1. Instead of connecting a security module 30 to a serial communication bus 10 and connecting the PCM 12 of the outboard motor 14 to that same bus, the PCM of the outboard motor 14 shown in FIG. 1 is configured to transmit signal requests in a manner generally similar to that described above in conjunction with FIG. 2. In other words, the PCM of the outboard motor 14 in FIG. 4 would transmit a signal to which the RFID tag 50 is configured to respond. The RFID tag 50 would respond with an identification value that would then be compared, by the PCM of the outboard motor 14, to an expected identification value. If a mismatch occurs, the PCM of the outboard motor 14 in FIG. 4 would disable the normal operation of the engine of the outboard motor. As described above, the initial installation of the outboard motor 14 to the marine vessel 60 would typically incorporate a step which allows a PCM with a blank or zero expected identification value to be activated to accept the actual identification value of the RFID tag 50 during that first operation. From then on, the stored expected identification value within the PCM would be used during subsequent interrogations to make sure that it matches the identification value of the RFID tag 50. The RFID tag 50 can be hidden or rigidly attached to the hull of the marine vessel 60 so that an attempt to remove it from the hull would result in its destruction without the returned actual identification value from the RFID tag 50, operation of the outboard motor 14 would be disabled. As a result, stealing the outboard motor 14 from the marine vessel 60 with which it was first associated would be made difficult or impossible. This is expected to decrease the number of thefts of marine vessel propulsion systems by removing the expected value of the stolen component.

Although the present invention has been described in particular detail and illustrated to show several embodiments, it should be understood that alternative embodiments are also within its scope.

We claim:

1. A method of deterring theft of a given protected component from a marine vessel, comprising:

installing a security device on said vessel, said security device comprising an identification code transmitter;

transmitting an initial interrogation signal from said protected component to said security device;

receiving said initial interrogation signal at said security device and, in response thereto, transmitting an identification code from said security device to said protected component;

receiving said identification code at said protected component and storing same as an expected identification code;

transmitting a subsequent interrogation signal from said protected component;

awaiting at said protected component a subsequent identification code, and responding to at least one of the following security-breach events to perform a designated function, a) non-receipt of an identification code within a given time increment, b) receipt of an identification code non-matching said expected identification code.

2. The method according to claim 1 comprising responding to said security-breach event by disabling said protected component, to reward theft of said protected component with disablement thereof.

3. The method according to claim 2 wherein said protected component is a marine propulsion control module, PCM, for controlling a marine engine, and wherein disablement of said PCM is selected from the group consisting of;

preventing operation of said engine;

limiting engine speed to less than a designated limp-home speed.

* * * * *